US006853341B1

(12) United States Patent
Hellgren et al.

(10) Patent No.: US 6,853,341 B1
(45) Date of Patent: Feb. 8, 2005

(54) ANTENNA MEANS

(75) Inventors: Mattias Hellgren, Täby (SE); Lars Carlsson, Årsta (SE)

(73) Assignee: Smarteq Wireless AB, Enebyberg (SE)

( * ) Notice: Subject to any disclaimer, the term of this patent is extended or adjusted under 35 U.S.C. 154(b) by 12 days.

(21) Appl. No.: 10/089,060

(22) PCT Filed: Oct. 4, 2000

(86) PCT No.: PCT/SE00/01933

§ 371 (c)(1),
(2), (4) Date: Jul. 1, 2002

(87) PCT Pub. No.: WO01/26182

PCT Pub. Date: Apr. 12, 2001

(30) Foreign Application Priority Data

Oct. 4, 1999 (SE) ..... 9903573

(51) Int. Cl.[7] ..... H01Q 11/12
(52) U.S. Cl. ..... 343/742; 343/748
(58) Field of Search ..... 343/803, 804, 343/805, 806, 828, 830, 906, 741, 742, 743, 748; 315/713, 803, 804, 805, 806, 828, 830, 906

(56) References Cited

U.S. PATENT DOCUMENTS 5,363,114 A * 11/1994 Shoemaker ..... 343/828
5,629,712 A 5/1997 Adrian et al. ..... 343/713
5,914,693 A * 6/1999 Takei et al. ..... 343/767
5,949,381 A * 9/1999 Saitoh et al. ..... 343/713
6,166,694 A * 12/2000 Ying ..... 343/702
6,329,962 B2 * 12/2001 Ying ..... 343/895
6,343,208 B1 * 1/2002 Ying ..... 455/575.7
6,489,925 B2 * 12/2002 Thursby et al. ..... 343/700 MS

FOREIGN PATENT DOCUMENTS

GB 2180695 A 4/1987
GB 2289163 A 11/1995

* cited by examiner

*Primary Examiner*—Don Wong
*Assistant Examiner*—Minh Dieu A
(74) *Attorney, Agent, or Firm*—Jacobson Holman PLLC

(57) ABSTRACT

The present invention relates to an antenna means for transmitting and/or receiving RF-signals in at least a first frequency band. The antenna means comprising a ground plane means (20) arranged to be connected to ground of a circuitry of a radio communication device, a conductive radiating structure (10) having a first end (12) and a second end (14), were said conductive radiating structure (10) being separated from the ground plane means (20). Said first end (12) being connected to ground end said second end (14) being a feed portion.

15 Claims, 3 Drawing Sheets

ANTENNA MEANS

This is a nationalization of PCT/SE00/01933 filed Oct. 4, 2000 and published in English.

FIELD OF THE INVENTION

The present invention relates to an antenna means in general and specifically to an antenna means for transceiving RF signals in at least a first frequency band.

DESCRIPTION OF THE RELATED ART

With the recent rapid progress of electronic communication technique, communication apparatuses having a higher function and smaller size have been developed and utilised for various kinds of mobile communication apparatuses.

Antenna means transmitting and receiving (transceiving) RF-signals on a single or dual frequency band are well known for a long time. Antennas according to the state of the art including single band antennas demands generally a quite large amount of space, which make them unpractical for use where there is a need for small and efficient antenna means.

A quarter wave monopole 1A shown in FIG. 1*a* has a wide spread use due to its simplicity and good match for single band application where its height (generally written $\lambda/4$ which is 80–90 mm for 800–900 MHz) is acceptable. It is for car applications generally made of a metallic pin inside some more or less fancy designed plastic tube. A bigger diameter (or wider strip if made as a circuit board) will increase the bandwidth and external matching components can be used for the same purpose. The, quarter wave monopole needs a ground plane which here is understood a rather big area of conducting material (having a diameter of one or more $\lambda$ at the operating frequency of the antenna) which is a problem.

A so called L antenna 1B is shown in FIG. 1*b*. The main radiation in such a structure comes from the vertical part with respective to a ground plane means 20 which by itself can be said to be a short monopole. The horizontal part is not radiating in proportion to its length but is rather a top loading to the vertical part. The top loading makes the radiating resistance up to 4 times higher than the monopole alone a fact which increases the bandwidth. Depending on the height of the vertical part the bandwidth can be sufficient for single band telephony in spite of a height in the order of $\lambda/8$. The band width will typically increase to the second or third power as a function of the height. Still multiband service is difficult to achieve and one obvious reason is that the total length is typically $\lambda/4$ which indicates drastically different matching conditions at twice the frequency when the height corresponds to $\lambda/2$ which is a problem.

The U.S. Pat. No. 5,629,712 discloses a vehicular radio reception antenna which is concealed within a body trim piece. Said antenna comprising a metal ground plane and a conducting loop connected to the ground plane at its first and second ends. Said loop circumscribes a slot area between the ground plane and the conducting loop. The length of the slot is selected to be $\lambda/2$ wavelength in the desired frequency band to be received by the antenna.

Since this kind of antenna is adapted to receive FM and/or AM signals said ½ wavelength of the slot corresponds to about 1.5 meters which is a problem when the cubic capacity is scarce. Another problem is that said antenna is dependent on the shape of the car. Yet another problem is that said antenna requires external components such as capacitors or inductors for power compensation and frequency matching.

Still another problem is that said antenna does not exhibit an omnidirectional radiating pattern.

SUMMARY OF TEE INVENTION

It is an object of the present invention to provide an antenna means which overcomes or at least reduces the above mentioned problems.

According to the present invention there is provided an antenna means as claimed in claim 1.

One advantage with the present invention is that the feeding of the antenna means is very simple.

Another advantage with the present invention is that the antenna is relatively simple to manufacture.

A further advantage with the present invention is that the antenna shows a good omnidirectional radiating pattern.

Yet another advantage with the invention is that due to its flexibility it can operate in at least one frequency band i.e. dual or multiple bands.

Yet another advantage is that with the radiating structure according to at least one of the embodiments of the invention it is relatively easy to alter for dual/multiple band operation with tuning/matching means.

Yet another advantage with the present invention is that the different parts of the antenna can easily be stored before assembling said antenna.

Yet another advantage with the present invention is that the antenna layout is relatively easy to alter.

Yet another advantage with the present invention is that single band performance is very good within a low height and multiband performance is good within the same height.

The invention will now be described in more detail with reference to preferred embodiments thereof and also with reference to the accompanying drawings.

DESCRIPTION OF PREFERRED EMBODIMENTS

In this disclosure it is to be understood that the antenna system of the invention is operable to receive and/or transmit (transceive) radio signals. Even if a term is used herein that suggests one specific signal direction it is to be appreciated that such a situation can cover that signal direction and/or its reverse.

Figure 1A:
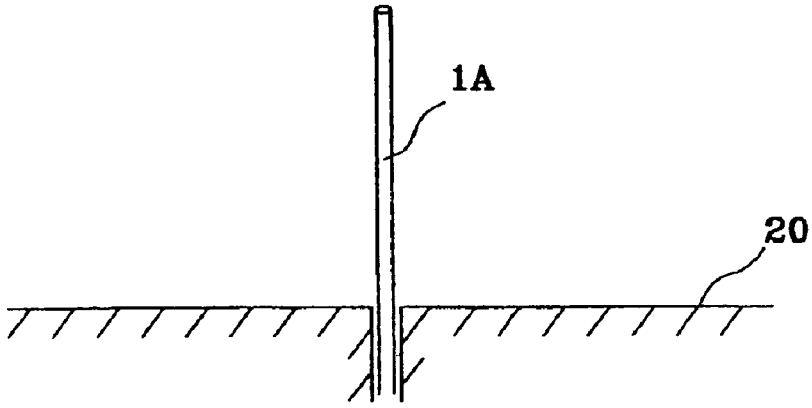
FIG. 1*a* shows a development stage of an antenna device according to the state of the art.
Figure 1B:
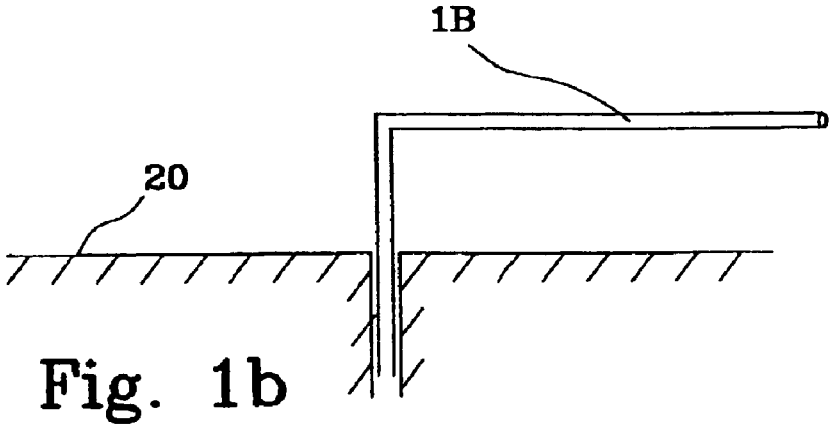
FIG. 1*b* shows a further development stage of an antenna device according to the state of the art.

FIGS. 1*a* and 1*b* is described in connection with the prior art above.

Figure 2:
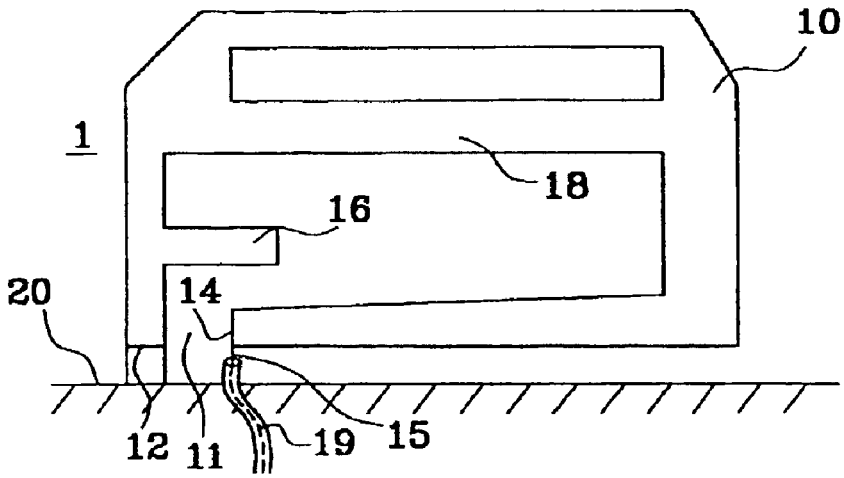
FIG. 2 shows a first embodiment of an antenna device according to the invention arranged on a ground plane means.

With reference to FIG. 2, a first embodiment of an antenna device 1 according to the invention is shown. The antenna device is arranged for transmission/reception of RF waves in at least one frequency band, e.g. in the 900 MHz band.

The antenna device 1 is to be connected to a radio communication device (not shown) arranged to a vehicle. As shown in the figures, the antenna device 1 is arranged on a ground plane means 20, such as a vehicle body. This ground plane means 20 will act as a ground plane. The ground plane means 20 can be replaced by a conductive ground plane of proper size in a radio communication device, e.g. a PCB (printed circuit board).

The antenna device 1 comprises a conductive radiating structure 10 for transmission/reception of RF waves in said frequency band(s).

The conductive radiating structure 10, being in this embodiment essentially rectangular shaped, comprises a first end 12, a second end 14, a tuning/matching means 16 and an bridge connector 18. A second elongated open loop (or internal elongated open loop) in said structure 10 is defined by the path from the first end to the second end via the bridge connector 18. A first elongated open loop (or an external elongated open loop) is defined as a longest path from the first end to the second end in the conductive radiating structure 10. In FIG. 2 the tuning/matching means 16 is with a first side capacitively and inductively coupled to a second side of the bridge connector 18 and partly with a second side capacitively and inductively coupled to a common side of the rectangular shaped first and second elongated open loops located closest to the ground plane. Said bridge connector 18 having a first side capacitively and inductively coupled to a side of the first rectangular shaped elongated open loop located furthest away from the ground plane. The opening 17 of the first and second elongated open loop structures is in this embodiment located at a corner of the rectangel between the tuning/matching means 16 and the ground plane means 20. However, the opening 17 can be arranged somewhere along the common side of the first and second elongated open loops.

Due to the frequency dependence of the inductive coupling the second elongated open loop has a small influence to the lower frequency band but much higher to the higher frequency band. Thus a more efficient optimization is possible for two or multiband service.

The conductive radiating structure formed as an elongated open loop 10 is to be connected to a transmission/feed, for example a coaxial cable 19, at its second end 14, being in this embodiment a feed portion 15. The feed line is connected to transceiver circuits of a radio communication device.

The first end 12 of conductive radiating structure 10 is connected to ground. The distance between the first end 12 and the second end 14 along the second elongated open conductive radiating structure is in the range of $\lambda/4$-$\lambda$, where $\lambda$ is the wavelength of the desired frequency in the frequency band to be received/transmitted by the antenna. The first elongated open loop can be tuned to its desired frequency by adjusting said distance between the first and second ends 12, 14, by cutting at the second end 14 of the conductive radiating structure 10. The distance between the first end 12 and the second end 14 along the first elongated open loop is dependent on the choice of frequency band. If the second elongated loop is adjusted to operate at a frequency at 1800 MHz and the first elongated loop is adjusted to receive a frequency at 900 MHz the relation between the distance between the first 12 and second ends of the first and second elongated loop is about 2:1.

The conductive radiating structure 10 is arranged on a ground plane means 20. The first end of the radiating structure is preferably capacitively connected to ground but can alternatively be galvanically connected to ground. If galvanically connected to ground said first end of the radiating structure can be provided with connection pins passing through holes in the ground plane means 20 acting as a ground plane or through holes in a metallic sheet acting as a ground plane. The pins are then preferably soldered to the ground plane means 20 or the metallic sheet.

The ground plane means 20 with a conductive portion of a proper size is sufficient for the antenna function, and the antenna device 1 can be mounted to a vehicle. However, if the antenna device 1 is mounted at a small height e.g. 0.5 mm above a vehicle roof or body, conductive portions of the vehicle are coupled, preferably capacitively, to the ground plane means 20. In this case said conductive portions also act as ground plane. However, the radiation of the antenna is dependent on the size of the ground plane.

The conductive radiating structure 10 is shown to be arranged orthogonal to the ground plane means 20. As mentioned above the first end of the conductive radiating structure is galvanically or capacitively coupled to the ground plane means 20. The second end of the conductive radiating structure is electrically isolated from the ground plane means 20. A transmission/feed line e.g. a coaxial cable 19 is with its electrical shielding connected to ground or directly to the first end of the radiating structure. A central conductor in the coaxial cable 19 is connected to the second end of the conductive radiating structure.

The conductive radiating structure 10 is preferably manufactured by stamping or cutting out the structure from a conductive plate e.g. metal plate. The width of the first and second elongated open loops in the conductive radiating structure 10 in the plane of the radiating structure is essentially larger than the thickness perpendicular to the plane of the structure. Said radiating structure can be arranged to a dielectric substrate by means of rivets, screws, glue, tape or other equivalent means. Alternatively, said radiating structure could de made out of a electrical conductor having for example a round, rectangular or triangular cross section. The structure could in a further alternative be formed on a dielectric carrier by printing or etching.

A surface defined by the conductive radiating structure is preferably orthogonal to the ground plane. However, said surface of the structure can be arranged at an angle $\alpha$ with respect to said ground plane, where said angle $\alpha$ is in the range of 30–150°. Said surface of the structure is preferably plane but can be curved or folded in a C-shaped or V-shaped manner respectively.

The direction of polarisation is orthogonal to the ground plane. The loop structure 10 radiates the desired frequency in a omnidirectional pattern.

Figure 3:
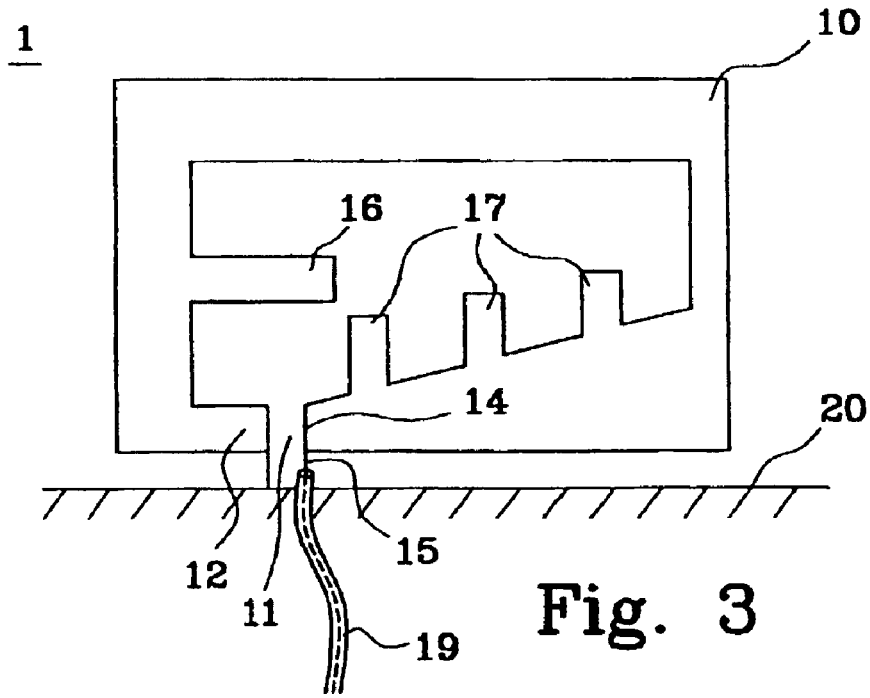
FIG. 3 shows a second embodiment of an antenna device according to the invention arranged on a ground plane means.

With reference to FIG. 3, a second embodiment of an antenna device 1 according to the invention is shown. The antenna device is arranged for transmission/reception of RF waves in at least one frequency band, e.g. in the 900 MHz band.

The antenna device 1 is to be connected to a radio communication device (not shown) arranged to a vehicle. As shown in FIG. 3, the antenna device 1 is arranged on a ground plane means 20. The ground plane means 20 could be a conductive ground plane of proper size in a radio communication device, e.g. a PCB (printed circuit board).

The antenna device 1 comprises a conductive radiating structure formed as an elongated open loop 10 for transmission/reception of RF waves in said frequency band (s).

The conductive radiating structure formed as an elongated open loop 10, being in this embodiment essentially rectangular shaped, comprises a first end 12 and a second end 14. Said conductive radiating structure formed as an elongated open loop further comprises tuning/matching means 16, 17. Said tuning/matching means being elements for tuning the radiating structure to the desired operating frequencies by the antenna. In this embodiment the tuning/matching means 16 is with a first side capacitively and inductively coupled to a side of the rectangular shaped elongated open loop structure being located furthest away from the ground plane means 20 and partly with a second side to a open portion (17) of said elongated open loop structure being located closest to the ground plane means 20.

The conductive radiating structure formed as an elongated open loop 10 is to be connected to a transmission/feed, for example a coaxial cable 19, at its second end 14 being in this embodiment a feed portion 15. The feed line is connected to transceiver circuits of a radio communication device.

The first end 12 of the conductive radiating structure formed as an elongated open loop 10 is connected to ground. The distance between the first end 12 and the second end 14 along the conductive radiating structure formed as an elongated open loop is in the range of $\lambda/4$-$\lambda$, where $\lambda$ is the wavelength of the desired frequency in the frequency band to be received/transmitted by the antenna. The conductive radiating structure formed as an elongated open loop 10 can be tuned to its frequency by adjusting said distance between its the first and second ends 12, 14, by cutting at the second end 14 of the conductive radiating structure formed as an elongated open loop 10.

The conductive radiating structure formed as an elongated open loop 10 is arranged on a ground plane means 20. The first end 12 of the conductive radiating structure formed as an elongated open loop 10 is preferably capacitively connected to ground but can alternatively be galvanically connected to ground. If galvanically connected to ground said first end of the conductive radiating structure formed as an elongated open loop can be provided with connection pins passing through holes in the ground plane means 20 acting as a ground plane or through holes in a metallic sheet acting as a ground plane. The pins are then preferably soldered to the ground plane means 20 or the metallic sheet.

The ground plane means 20 with a conductive portion of a proper size is sufficient for the antenna function, and the antenna device 1 can be mounted to a vehicle. However, if the antenna device 1 is mounted at a small height e.g. 0.5 mm above a vehicle roof or body, conductive portions of the vehicle are coupled, preferably capacitively, to the ground plane means 20. In this case said conductive portions also act as ground plane. However, the radiation of the antenna is dependent on the size of the ground plane.

The conductive radiating structure formed as an elongated open loop 10 is shown to be arranged orthogonal to the ground plane means 20. As mentioned above the first end of the conductive radiating structure formed as an elongated open loop is capacitively or galvanically coupled to the ground plane means 20. The second end of the conductive radiating structure formed as an elongated open loop is electrically isolated from the ground plane means 20, i.e. ground. A transmission/feed line e.g. a coaxial cable 19 is with its electrical shielding connected to ground or directly to the first end of the conductive radiating structure formed as an elongated open loop. A central conductor in the coaxial cable 19 is connected to the second end of the conductive radiating structure formed as an elongated open loop.

The conductive radiating structure formed as an elongated open loop 10 is preferably manufactured by stamping or cutting out the structure from a conductive plate e.g. metal plate, i.e. manufactured in one piece. The width of the conductive radiating structure formed as an elongated open loop in the plane of the radiating structure is essentially larger than the thickness perpendicular to the plane of the structure. Said radiating structure can be arranged to a dielectric substrate by means of rivets, glue, screws, tape or other equivalent means.

A surface defined by the conductive radiating structure 10 formed as an elongated open loop is preferably orthogonal to the ground plane. However, said surface of the conductive radiating structure formed as an elongated open loop can be arranged at an angle $\alpha$ with respect to said ground plane, where said angle $\alpha$ is in the range of 30–150°. Said surface of the conductive radiating structure formed as an elongated open loop is preferably a plane surface but can be curved or folded in a C-shaped or V-shaped manner respectively.

The direction of polarisation is orthogonal to the ground plane. The conductive radiating structure formed as an elongated open loop 10 radiates the desired frequency in a omnidirectional pattern.

Figure 4:
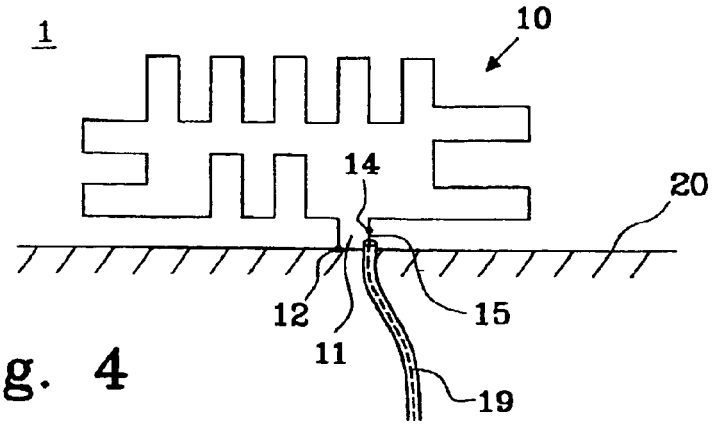
FIG. 4 shows a third embodiment of an antenna device according to the invention arranged-on a ground plane means.

With reference to FIG. 4, a third embodiment of an antenna device 1 according to the invention is shown. The antenna device is arranged for transmission/reception of RF waves in at least one frequency band, e.g. in the 900 MHz band.

The antenna device 1 is to be connected to a radio communication device (not shown) arranged to a vehicle. As shown in the figure, the antenna device 1 is arranged on a ground plane means 20, such as a vehicle body. This ground plane means 20 will act as a ground plane. The ground plane means 20 can be replaced by a conductive ground plane of proper size in a radio communication device, e.g. a PCB (printed circuit board). The radiation from the antenna device is dependent on the size of the ground plane.

The antenna device 1 comprises a conductive radiating structure 10 formed as an elongated open loop (EOLA) for transmission/reception of RF waves in said frequency band (s)

The conductive radiating structure 10, being in this embodiment essentially meander shaped, comprises a first end 12 and a second end 14. The conductive radiating structure can be seen as derived from an L antenna with a second vertical part added and also a horizontal bottom part. The last horizontal part is radiating very little due to its position close to the ground plane. Its important mission however is to be a kind of low reactive impedance load (as compared to an open end) to the second vertical part in order to enable a second vertical current. Furthermore it is possible to chose parameters to give said reactive impedance a size appropriate for adjusting the phase of said current so that the current in the two vertical parts are co-operating in order to increase bandwidth and make the radiation omnidirectional.

In some applications (like a car or a boat with a plastic roof) a very small ground plane can be used and the flexibility of the radiating structure formed as an elongated open loop allows the tuning of the antenna to the small ground plane in spite of the difference of the impedance conditions. The small ground plane is here defined as a plane having a radius being less than $\lambda$ at the desired operating frequency by the antenna.

The conductive radiating structure 10 is to be connected to a feed line, which could be any type of transmission/feed line, at its second end 14. The feed line is connected to transceiver circuits of a radio communication device.

The first end 12 of the conductive radiating structure 10 is connected to ground of the radio communication device. The distance between the first end 12 and the second end 14 along the conductive radiating structure 10 is in the range of $\lambda/4$-$\lambda$, where $\lambda$ is the wavelength of the desired frequency in the frequency band(s) to be received/transmitted by the antenna. The conductive radiating structure can be tuned to its frequency by adjusting said distance between its the first and second ends 12, 14, by cutting at the second end 14 of the conductive radiating structure 10.

The conductive radiating structure 10 is arranged on a ground plane means 20. The first end of the loop structure is preferably galvanically connected to ground but can alternatively be capacitively connected to ground. If galvanically connected to ground said first end of the radiating structure can be provided with connection pins passing through holes in the ground plane means 20 acting as a ground plane or through holes in a metallic sheet acting as a ground plane. The pins are then preferably soldered to the ground plane means 20 or the metallic sheet.

The ground plane means 20 includes a substrate with a conductive portion of a proper size is sufficient for the antenna function, and the antenna device 1 can be mounted to a vehicle. However, if the antenna device 1 is mounted at a small height e.g. 0.5 mm above a vehicle roof or body, conductive portions of the vehicle are coupled, capacitively, to the conductive portion of the ground plane means 20. In this case said conductive portions also act as ground plane. The radiation of the antenna is however dependent on the size of the ground plane.

The conductive radiating structure formed as an elongated open loop 10 is shown to be arranged orthogonal to the ground plane means 20. As mentioned above the first end of the conductive radiating structure formed as an elongated open loop is galvanically or capacitively coupled to the ground plane means 20. The second end 14 of the conductive radiating structure formed as an elongated open loop is electrically isolated from the ground plane means 20. A transmission line/feed line e.g. a coaxial cable 19 is with its electrical shielding connected to ground or directly to the first end of the conductive radiating structure formed as an elongated open loop 10. A central conductor 15 in the coaxial cable 19 is connected to the second end 14 of the conductive radiating structure formed as an elongated open loop 10. Said second end being in thus embodiment a feed portion.

The conductive radiating structure formed as an elongated open loop 10 is preferably manufactured by stamping or cutting out the structure from a conductive plate e.g. metal plate. The width of the conductive radiating structure formed as an elongated open loop in the plane of the radiating structure is essentially larger than the thickness perpendicular to the plane of the structure. Said conductive radiating structure formed as an elongated open loop can be arranged on a carrier in the form of a dielectric substrate. Alternatively, said radiating structure could be made out of an electrical conductor having for example a round, rectangular or triangular cross section. The structure could in a further alternative be formed on a dielectric carrier by printing or etching.

A surface defined by the conductive radiating structure formed as an elongated open loop 10 is preferably orthogonal to the ground plane means 20. However, said surface of the conductive radiating structure formed as an elongated open loop 10 can be arranged at an angle $\alpha$ with respect to said ground plane, where said angle $\alpha$ is in the range of 30–150°. Said surface of the conductive radiating structure formed as an elongated open loop 10 is preferably a plane surface but can be curved or folded in a C-shaped or V-shaped manner respectively.

The direction of polarisation is orthogonal to the ground plane means 20. The conductive radiating structure formed as an elongated open loop 10 radiates the desired frequency in a omnidirectional pattern.

Figure 5:
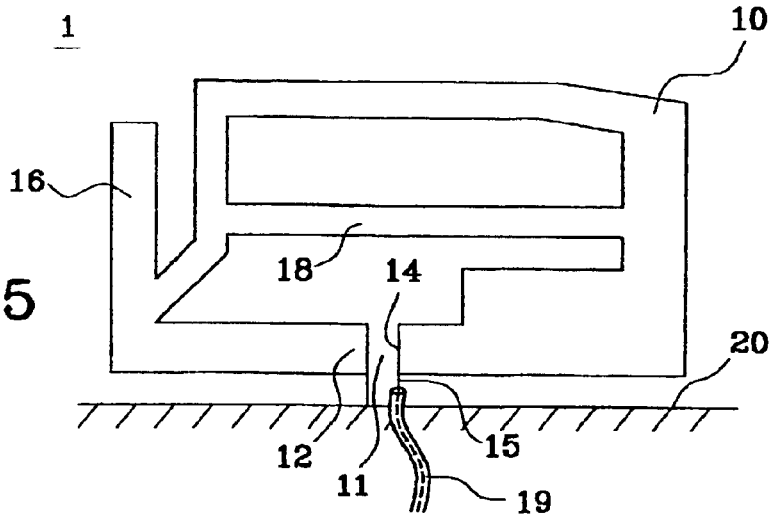
FIG. 5 shows a fourth embodiment of an antenna device according to the invention arranged on a ground plane means.

With reference to FIG. 5, a fourth embodiment of an antenna device 1 according to the invention is shown. The antenna device is arranged for transmission/reception of RF waves in at least one frequency band, e.g. in the 900 MHz band.

The antenna device 1 is to be connected to a radio communication device (not shown) arranged to a vehicle. As shown in the figures, the antenna device 1 is arranged on a ground plane means 20, such as a vehicle body. This ground plane means 20 will act as a ground plane. The ground plane means 20 can be replaced by a conductive ground plane of proper size in a radio communication device, e.g. a PCB (printed circuit board).

The antenna device 1 comprises a conductive radiating structure 10 for transmission/reception of RF waves in said frequency band(s).

The conductive radiating structure 10, being in this embodiment essentially rectangular shaped, comprises a first end 12, a second end 14, a tuning/matching means 16 and an bridge connector 18. A second elongated open loop (or internal elongated open loop) in said structure 10 is defined by the path from the first end to the second end via the bridge connector 18. A first elongated open loop (or an external elongated open loop) is defined as a longest path from the first end to the second end in the conductive radiating structure 10. In FIG. 4 the tuning/matching means 16 is with a first side capacitively and inductively coupled to a second side of the bridge connector 18 and partly with a second side capacitively and inductively coupled to a common side of the rectangular shaped first and second elongated open loops located closest to the ground plane. Said bridge connector 18 having a first side capacitively and inductively coupled to a side of the first rectangular shaped elongated open loop located furthest away from the ground plane. The opening 17 of the first and second elongated open loop structures is in this embodiment located at a corner of the rectangel between the tuning/matching means 16 and the ground plane means 20. However, the opening 17 can be arranged somewhere along the common side of the first and second elongated open loops.

Due to the frequency dependence of the inductive coupling the second elongated open loop has a small influence to the lower frequency band but much higher to the higher frequency band. Thus a more efficient optimization is possible for two or multiband service.

In FIG. 5 the tuning/matching means 16 is with a first side capacitively and inductively coupled to a side of the rectangular shaped radiating structure 10 located perpendicular to the ground plane means 20. The tuning/matching means is introduced to optimize performance in the highest band only. In this embodiment said tuning/matching means can be seen as an extra mono pole. Said bridge connector 18 having a first side capacitively and inductively coupled to a side of the first rectangular shaped elongated open loop located furthest away from the ground plane. Said bridge connection having parts of a second side capacitively and inductively coupled to an open portion 17 of the common side of the rectangular shaped first and second elongated open loops located closest to the ground plane. The opening portion 17 of the first and second elongated open loops is in this embodiment located in a middle of the common side of said rectangular shaped loops being located closest to the ground plane.

The conductive radiating structure formed as a first and second elongated open loops 10 is to be connected to a transmission/feed line. The transmission line/feed line that could be a coaxial cable 19 is with its central conductor 15 feeding the radiating structure at the second end being a feed portion. The transmission/feed line is connected to transceiver circuits of a radio communication device.

The first end 12 of conductive radiating structure 10 is connected to ground. The distance between the first end 12 and the second end 14 along the second elongated open conductive radiating structure is in the range of $\lambda/4$-$\lambda$, where $\lambda$ is the wavelength of the desired frequency in the frequency band to be received/transmitted by the antenna. The first elongated open loop can be tuned to its desired frequency by adjusting said distance between the first and second ends 12, 14, by cutting at the second end 14 of the conductive radiating structure 10. The distance between the first end 12 and the second end 14 along the first elongated open loop is dependent on the choice of frequency band. If the second elongated loop is adjusted to operate at a frequency at 1800 MHz and the first elongated loop is adjusted to receive a frequency at 900 MHz the relation between the distance between the first 12 and second ends of the first and second elongated loop is about 2:1.

The conductive radiating structure 10 is arranged on a ground plane means 20. The first end of the radiating structure is preferably capacitively connected to ground but can alternatively be galvanically connected to ground. If galvanically connected to ground said first end of the radiating structure can be provided with connection pins passing through holes in the ground plane means 20 acting as a ground plane or through holes in a metallic sheet acting as a ground plane. The pins are then preferably soldered to the ground plane means 20 or the metallic sheet.

The ground plane means 20 with a conductive portion of a proper size is sufficient for the antenna function, and the antenna device 1 can be mounted to a vehicle. However, if the antenna device 1 is mounted at a small height e.g. 0.5 mm above a vehicle roof or body, conductive portions of the vehicle are coupled, preferably capacitively, to the ground plane means 20. In this case said conductive portions also act as ground plane. However, the radiation of the antenna is dependent on the size of the ground plane.

The conductive radiating structure 10 is shown to be arranged orthogonal to the ground plane means 20. As mentioned above the first end of the conductive radiating structure is galvanically or capacitively coupled to the ground plane means 20. The second end of the conductive radiating structure is electrically isolated from the ground plane means 20. A transmission/feed line e.g. a coaxial cable 19 is with its electrical shielding connected to ground or directly to the first end of the radiating structure. A central conductor in the 19 cable is connected to the second end of the conductive radiating structure.

The conductive radiating structure 10 is preferably manufactured by stamping or cutting out the structure from a conductive plate e.g. metal plate. The width of the first and second elongated open loops in the conductive radiating structure 10 in the plane of the radiating structure is essentially larger than the thickness perpendicular to the plane of the structure. Said radiating structure can be arranged to a dielectric substrate by means of rivets, screws, glue, tape or other equivalent means. Alternatively, said radiating structure could de made out of a electrical conductor having for example a round, rectangular or triangular cross section. The structure could in a further alternative be formed on a dielectric carrier by printing or etching.

A surface defined by the conductive radiating structure is preferably orthogonal to the ground plane. However, said surface of the structure can be arranged at an angle $\alpha$ with respect to said ground plane, where said angle $\alpha$ is in the range of 30–150°. Said surface of the structure is preferably plane but can be curved or folded in a C-shaped or V-shaped manner respectively.

The direction of polarisation is orthogonal to the ground plane. The loop structure 10 radiates the desired frequency in a omnidirectional pattern.

Figure 6:
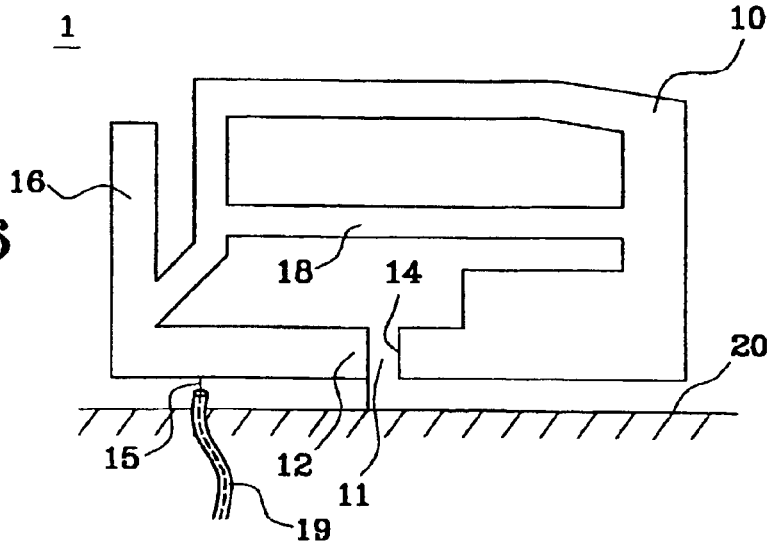
FIG. 6 shows a fifth embodiment of an antenna device according to the invention arranged on a ground plane means.

FIG. 6 shows yet another embodiment where the feeding point is moved from the second end of the elongated open loop to a point near the first end 12 but still close to the ground plane means 20. This will change the impedance level but will basically maintain the frequency dependence of the impedance.

The conductive radiating structure can be mounted on a substrate together with another antenna device, e.g. a GPS antenna forming an antenna assembly. Said antenna assembly can be covered and protected by a housing. The substrate is preferably made of a dielectric material which could be provided with a conductive pattern connected to ground.

In the previous embodiments the antenna means has been provided with a ground plane means 20. When mounted on a vehicle, this ground plane means 20 can be coupled to conductive portions of the vehicle galvanically and/or capacitively. Alternatively the ground plane means 20 can be omitted and the conductive portions of the vehicle act as ground plane means.

What is claimed is:

1. An antenna means for transmitting and/or receiving RF signals in at least a first frequency band, comprising:

a ground plane means arranged to be connected to ground of a circuitry of a radio communication device, a conductive radiating structure arranged to be separated from said ground plane means and having a first end and a second end, wherein, said conductive radiating structure has a total length of $\lambda/4$-$\lambda$ at a frequency in the frequency band to be received and/or transmitted by the antenna, said conductive radiating structure is formed as at least a first elongated open loop, said first end is arranged to be connected to ground of said radio communication device, and a feed portion is arranged in vicinity of the first and/or second ends.

2. The antenna means according to claim 1, wherein said second end is a feed portion.

3. The antenna means according to claim 1, wherein said conductive radiating structure is a flexible film attached to a dielectric substrate.

4. The antenna means according to claim 1, wherein said conductive radiating structure exhibits at least a planar section, said planar section is forming an angle ($\alpha$) with said ground plane means; and said angle ($\alpha$) being in the range of 30–150°.

5. The antenna means according to claim 4, wherein a surface of said conductive radiating structure is curved or folded such as to include C-shapes or V-shapes.

6. The antenna means according to claim 1, wherein said conductive radiating structure is meander shaped.

7. The antenna means according to claim 1, said antenna means further comprises a tuning/matching means for tuning/matching to one or multiple frequencies.

8. The antenna means according to claim 7, wherein said tuning/matching means is an electrical conductor having a first end and a second end, where said first end being arranged to said at least one elongated open loop, said second end being a free end and at least a part of at least one side of said conductor being capacitively coupled to said at least one elongated open loop.

9. The antenna means according to claim 8, wherein said electrical conductor is meander shaped.

10. The antenna means according to claim 1, wherein said antenna means further comprises at least one bridge connector which is an electrical conductor with a first end and a second end, each connected to different parts of said at least one elongated open loop.

11. The antenna means according to claim 10, wherein a side of said bridge connector is capacitively and inductively coupled to a side of a first elongated open loop in said conductive radiating structure.

12. The antenna means according to claim 10, wherein a tuning/matching means for tuning/matching to one or multiple frequencies is arranged close to said bridge connector for forming a capacitive and inductive coupling therebetween.

13. The antenna means according to claim 10, wherein said bridge connector is meander shaped.

14. The antenna means according to claim 1, wherein the first end of the conductive radiating structure is coupled to ground.

15. An antenna assembly including an antenna means according to claim 1, wherein the assembly comprises at least one further antenna element for transmitting/receiving radio frequency signals, for instance, a GPS antenna.

* * * * *